United States Patent [19]

Vornberger

[11] 4,266,313

[45] May 12, 1981

[54] BOOT UPPER QUARTER MOLDING MACHINE

[75] Inventor: Walter Vornberger, Tewksbury, MA

[73] Assignee: International Shoe Machine Corporation, Nashua, N.H.

[21] Appl. No.: 114,766

[22] Filed: Jan. 23, 1980

[51] Int. Cl.[3] ..... A43D 11/00

[52] U.S. Cl. ..... 12/54.3; 12/53.5

[58] Field of Search ..... 12/12.5, 10.1, 10.5, 12/10.8, 14.4, 53.5, 54.3, 8.2, 145

[56] References Cited

U.S. PATENT DOCUMENTS

| | | | |
|---|---|---|---|
| 2,983,934 | 5/1961 | Bertrand | 12/54.3 |
| 3,307,210 | 3/1967 | Lauretti | 12/8.2 |
| 3,320,626 | 5/1967 | Kamborian et al. | 12/145 |
| 3,345,661 | 10/1967 | Wilisch | 12/54.3 |

*Primary Examiner*—Patrick D. Lawson

*Attorney, Agent, or Firm*—Albert Gordon

[57] ABSTRACT

A machine for molding the quarter of a boot upper by causing a female mold (36) to press the quarter against a male mold (74). The male mold (74) is mounted bottom-up by a stem (76) connected by the front portion (72) of a beam (70) to the machine frame (14). The beam front portion (72) has a cavity (84) located above the rearmost end (82) of the male mold (74).

4 Claims, 11 Drawing Figures

BOOT UPPER QUARTER MOLDING MACHINE

BACKGROUND OF THE INVENTION

U.S. Pat. Nos. 2,983,934, 3,307,210 and 3,345,661 are illustrative of prior art machines that mold the quarter of a shoe upper by pressing the quarter against a male mold by a female mold. In U.S. Pat. Nos. 3,307,210 and 3,345,661, the quarter is also flanged by causing wipers to wipe the margin of the quarter against the bottom surface of the male mold. In U.S. Pat. No. 2,983,934 the male mold is so supported that its bottom extends substantially vertically. In U.S. Pat. No. 3,307,210, the male mold is supported bottom-up. In U.S. Pat. No. 3,345,661, the male mold is supported bottom-down by a stem that is secured to and extends downwardly of the bottom surface of the male mold. In U.S. Pat. Nos. 2,983,934 and 3,345,661 pincers are provided that grip the side portions of the upper margin while the molding and flanging operation takes place with the pincers being disclosed in U.S. Pat. No. 2,983,934 as moving away from the rearmost portion of the male die prior to the molding operation to thereby stretch the quarter about the male mold.

U.S. Pat. No. 3,320,626 shows a heel seat lasting machine that stretches an upper about the heel portion of a last by pincers that grip the upper margin prior to the clamping of the heel portion of the upper against the last by a heel clamp and prior to the wiping of the heel portion of the upper margin against an insole mounted to the bottom of the last by heel wipers. In U.S. Pat. No. 3,320,626, the pincers may be caused to release the upper margin after they have been moved away from the heel portion of the last to effect the stretching operation if the upper is determined by the operator to have not properly effected the stretching operation and the pincers may then be caused to again grip the upper margin and effect the stretching operation.

SUMMARY OF THE INVENTION

In the molding or the molding and flanging of the quarters of uppers, it has been found desirable to visually observe whether the quarter has been properly placed on the male mold with the quarter back line in alignment with the rearmost end of the male mold prior to effecting the molding operation or the molding and flanging operation. In addition when the upper is a boot upper having a relatively long shaft, space must be provided to accommodate the shaft during the molding operation or the molding and flanging operation. In order to achieve these results, the molding machine of this invention includes a male mold that is supported bottom-up by a stem that is secured to and extends upwardly of the bottom surface of the male mold, the stem being so connected by connecting means to the machine frame as to render the rearmost end of the stem visible from above the connecting means. In addition, in order to accommodate the upper shaft, the machine is so constructed and arranged that the space beneath the downwardly facing top surface of the male mold is free of any machine parts for a distance sufficient to accommodate the upper shaft.

DESCRIPTION OF THE PREFERRED EMBODIMENT

Two pincers 10 (FIGS. 1, 3, 6 and 7) are at the end of the machine that faces the operator of the machine. The machine parts that are closest to the operator will be considered to be their fronts and the machine parts that are furthest from the operator will be considered to be their backs. Movements of machine parts toward the operator will be considered to be "forward" and movements of machine parts away from the operator will be considered to be "rearward".

For ease of presentation of shoe uppers to the machine, the machine is inclined downwardly and forwardly from the horizontal. For ease of explanation, the machine will be described as not being so inclined so that, for example, the axes of forwardly-rearwardly extending bars 12 (see FIGS. 1, 3 and 6) will be considered to be horizontal rather than inclined downwardly and forwardly and directions extending heightwise at right angles to the axes of the bars 12 will be considered to be vertical.

Figure 1:
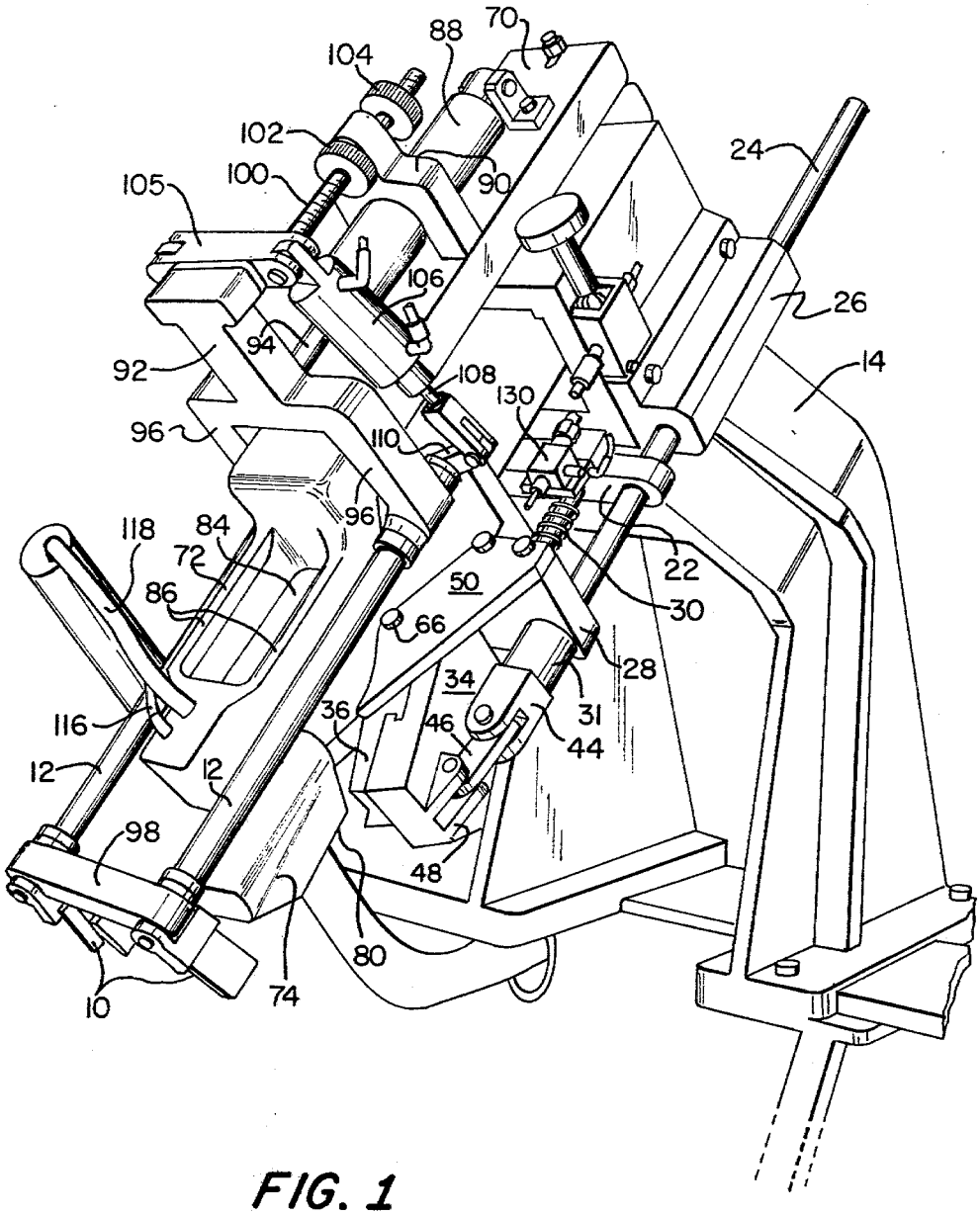
FIG. 1 is an isometric view of the machine.
Figure 2:
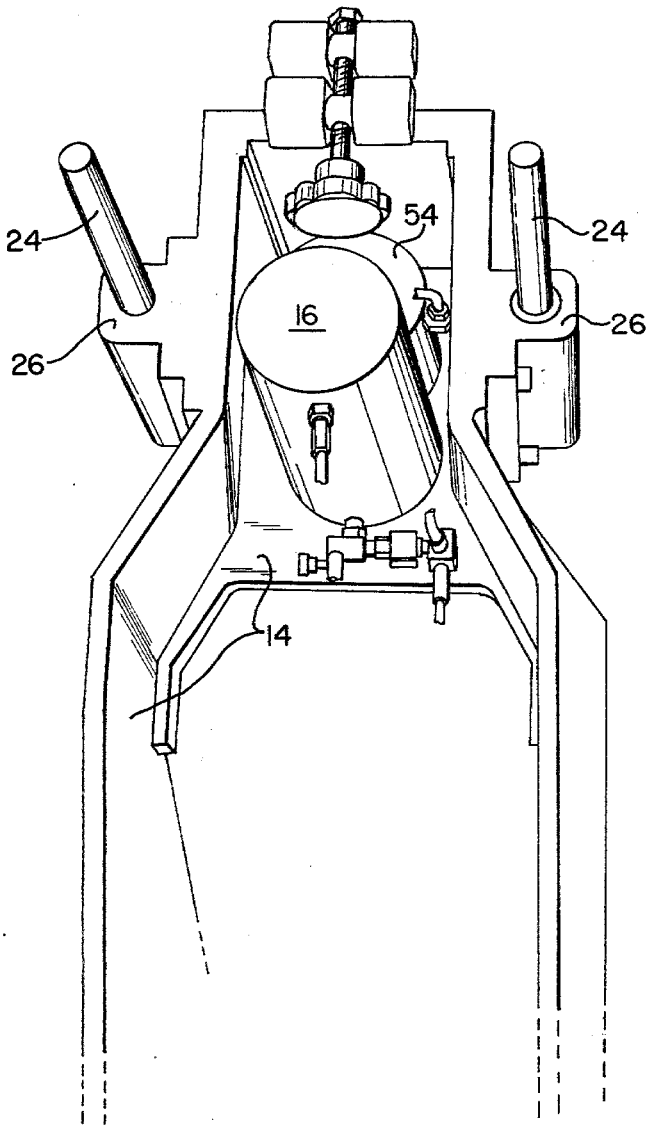
FIG. 2 is a back view of the machine.
Figure 3:
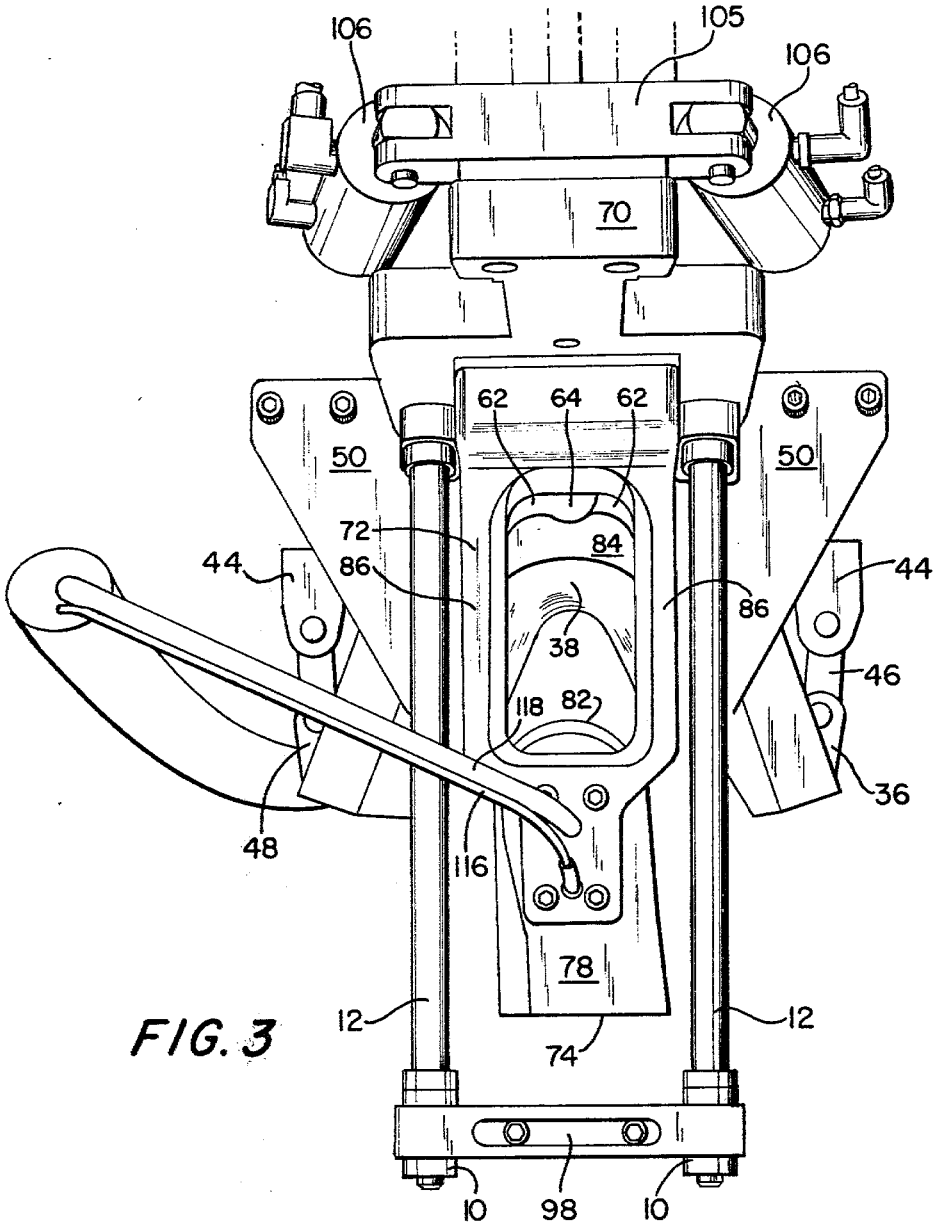
FIG. 3 is a top plan view of the machine.
Figure 4:
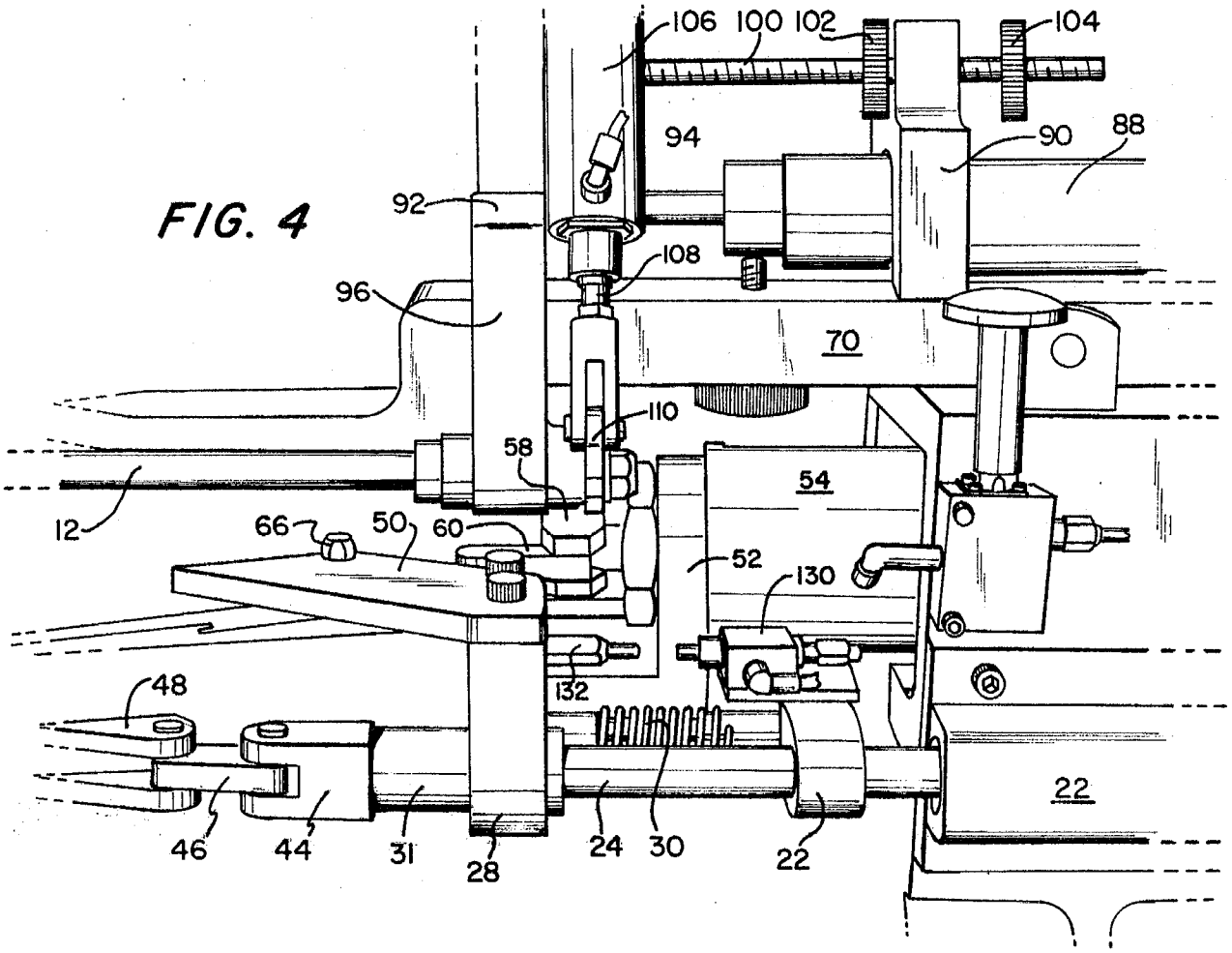
FIG. 4 is a side view of a portion of one side of the machine.
Figure 5:
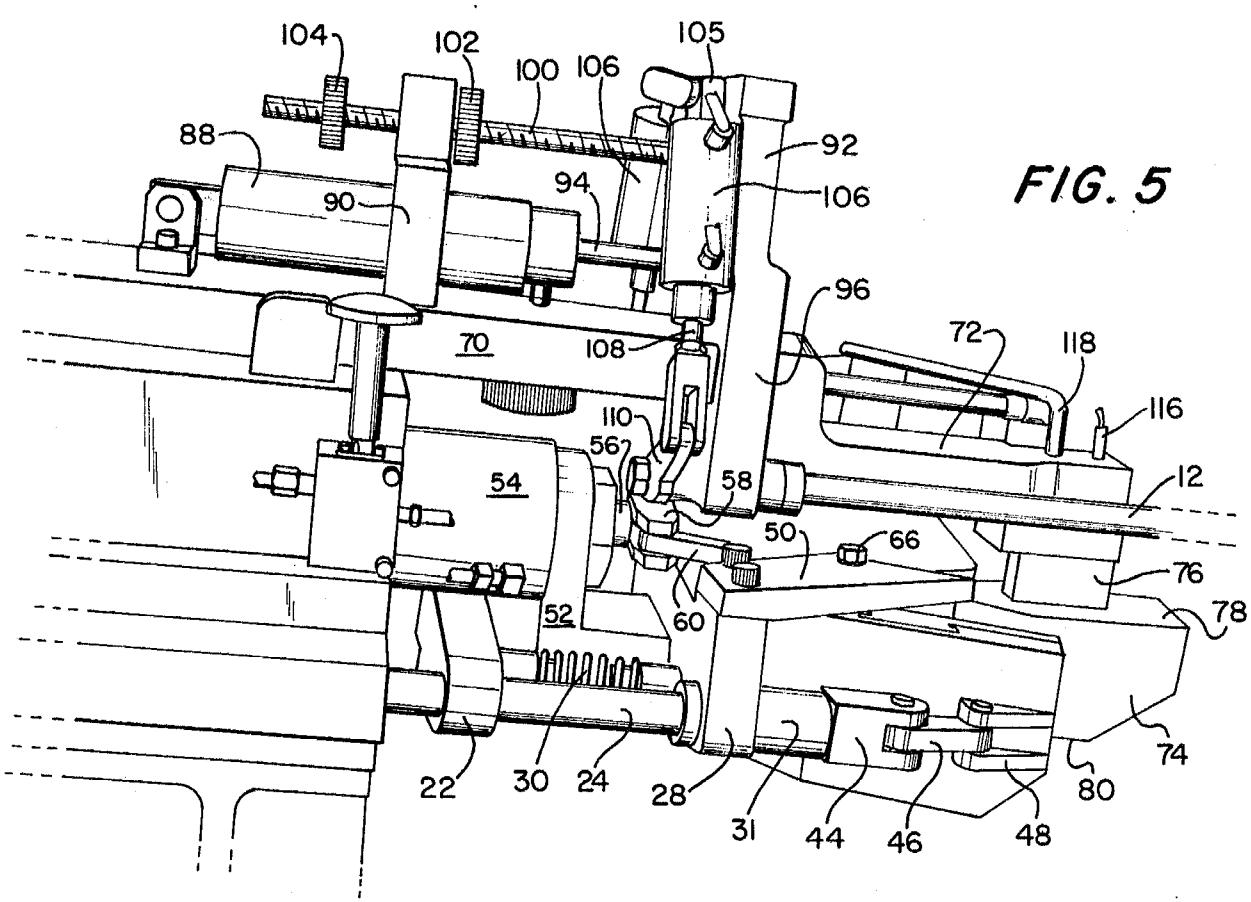
FIG. 5 is a side view of a portion of the other side of the machine.
Figure 6:
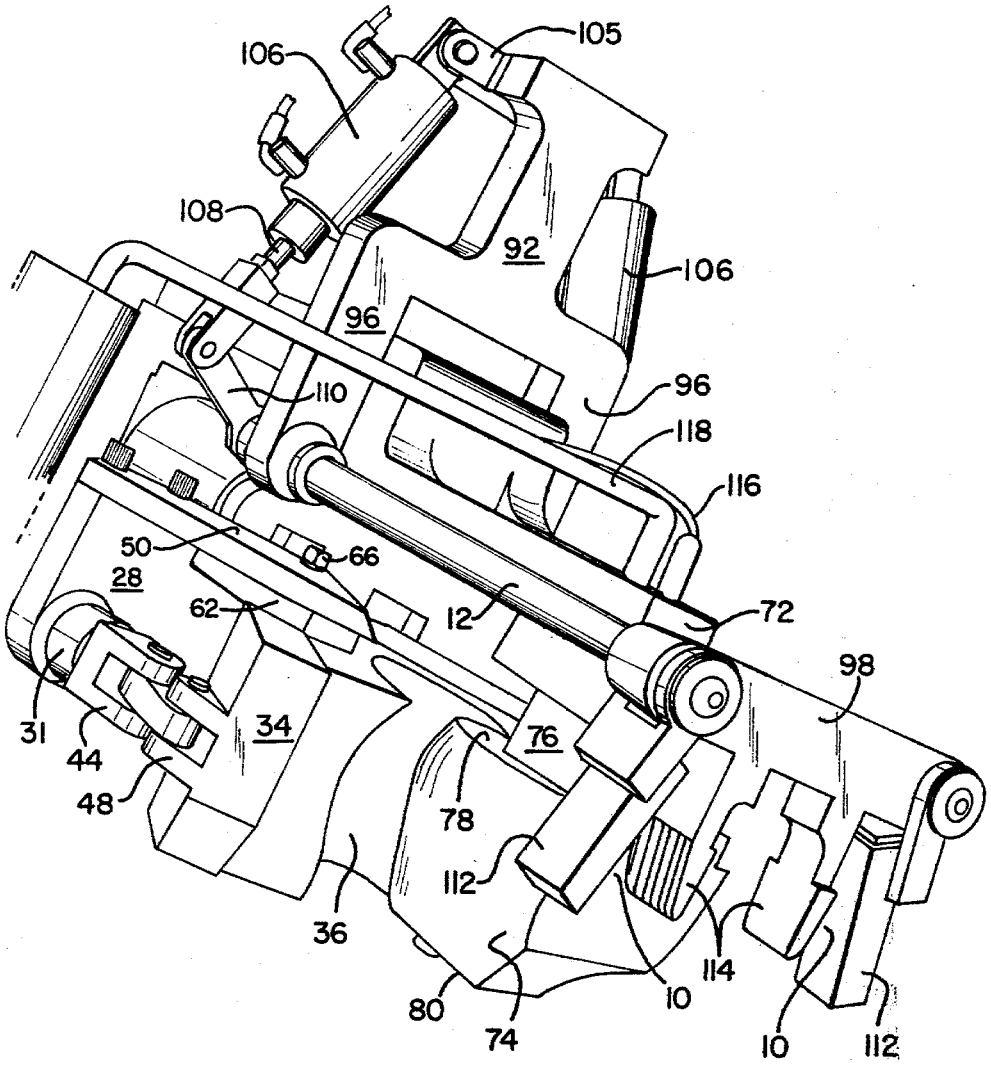
FIG. 6 is an isometric view of the front portion of the machine.
Figure 7:
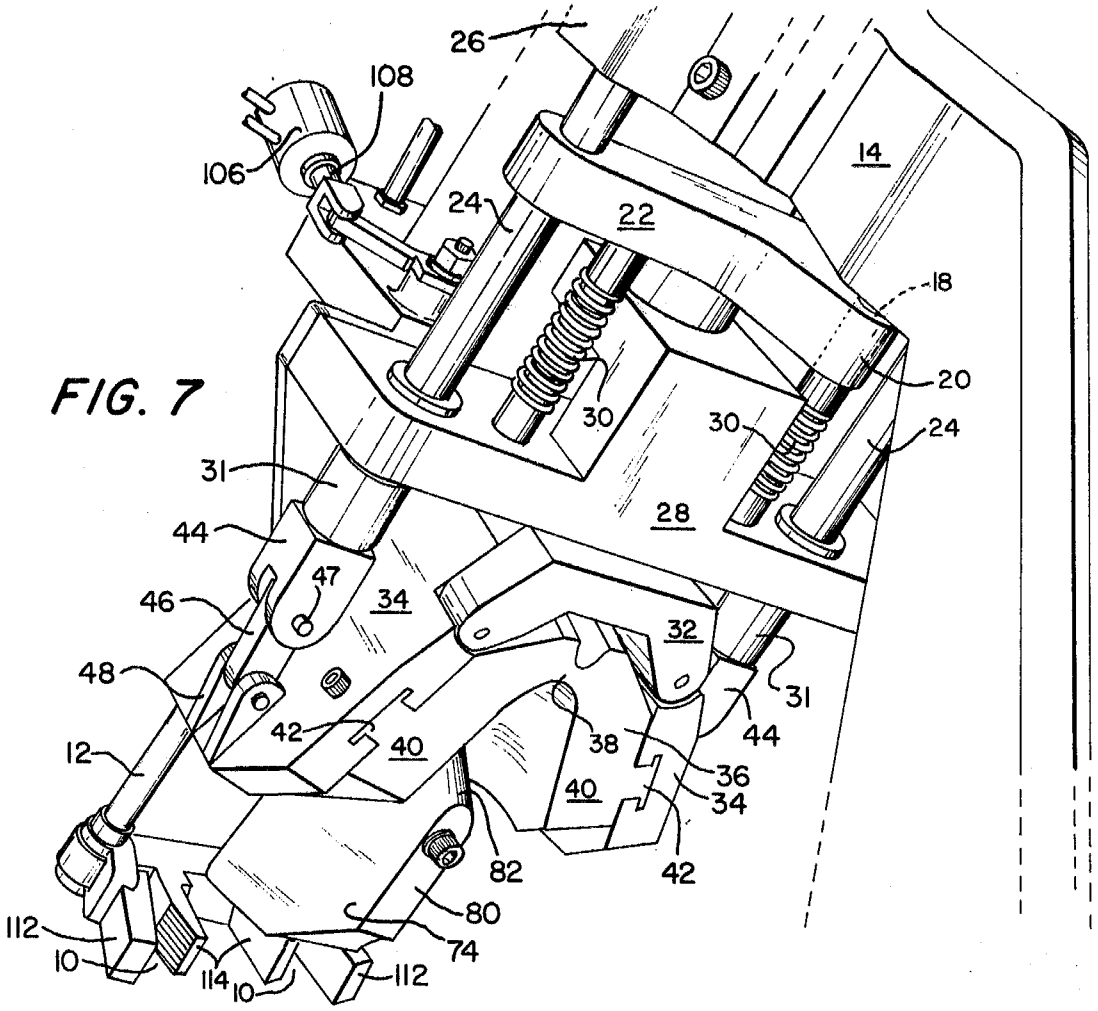
FIG. 7 is an isometric view of a portion of the bottom of the machine.
Figure 8:
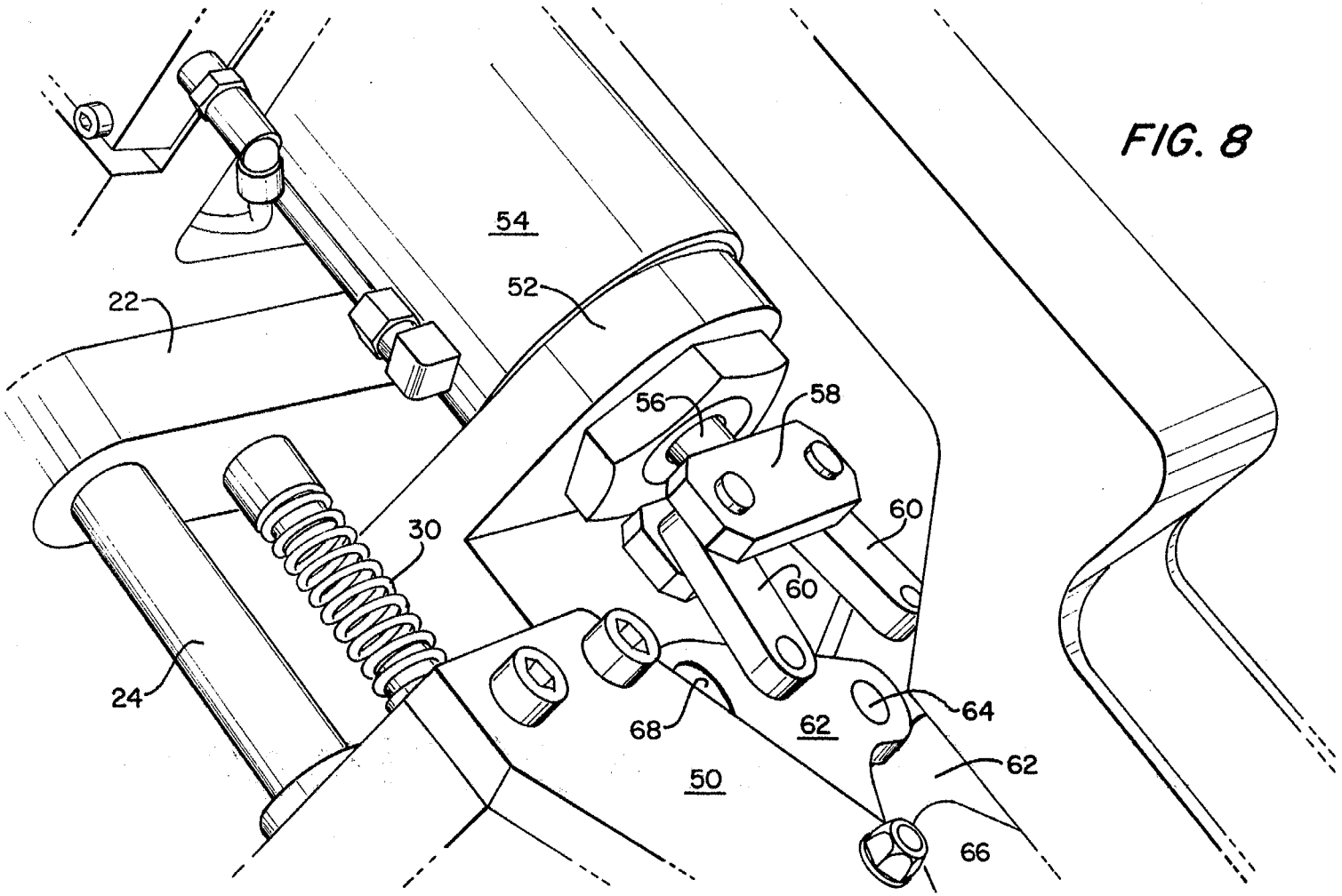
FIG. 8 is an isometric view of a wiper driving mechanism in the machine.

Referring to FIGS. 1, 2 and 7, the machine has a stationary frame 14 having a pneumatic motor 16 mounted thereto. The forwardly directed piston rod 18 (FIG. 7) of the motor 16 extends through and is secured to an ear 20 of a bracket 22. The sides of the bracket 22 are secured to shafts 24 that are guided for forward-rearward movement in ears 26 of the frame 14. A block 28 is located forwardly of the bracket 22 and is slidably mounted on the shafts 24 for forward-rearward movement. Compression springs 30 interposed between the bracket 22 and the block 28 yieldably urge the block 28 forwardly of the bracket 22 along the shafts 24 to a forward position wherein the block 28 engages collars 31 that are rigidly mounted on the shafts 24.

Referring to FIG. 7, a back mold mounting element 32 is secured to and extends forwardly of the block 28 and side mold mounting elements 34 are pivoted to the sides of the back mold mounting element 32 and extend forwardly and divergently of the back mold mounting element 32. A generally U-shaped female mold 36, having a bight 38 and legs 40 extending forwardly and divergently of the bight 38, is mounted to the side mold mounting elements 34 by connections 42. The female mold is made of a flexible material such as polyurethane. A clevis 44 is mounted to each shaft 24 forwardly of its collar 31. A link 46 is pivoted at its back to each clevis 44 by a pivot pin 47 and is pivoted at its front to a clevis 48 on each side mold mounting element 34.

Referring to FIGS. 1, 3, 5 and 8, a plate 50 is mounted to each side of the block 28 and extends forwardly thereof and spacedly above the mounting elements 32,34 and the female mold 36. An angle piece 52 is secured to and extends rearwardly of the block 28. A pneumatic motor 54, having a forwardly directed piston rod 56, is connected at its front to a strap 58. The backs of a pair of links 60 are pivoted to the opposite sides of the strap 58. The front of each link 60 is pivoted to a wiper 62. The wipers 62 are pivoted to each other at their vertex 64, extend forwardly and divergently from the vertex 64 and are slidable in the space between the plates 50 and the mounting elements 32,34 and the female mold 36. A pin 66 is mounted in and depends from each plate 50. The bottom of each pin 66 is located in a curved slot 68 (FIG. 8) in a wiper 62.

Referring to FIGS. 1 and 3-6, the frame 14 has a beam 70 at its top. The front portion 72 of the beam 70 extends above and forwardly of the female mold bight 38 and the wiper vertex 64. A male mold 74 is secured to and depends from the front of the beam front portion 72 by a stem 76. The upwardly facing surface 78 (hereafter referred to as the bottom surface) of the male mold 74 lies in a substantially horizontal plane that is parallel to and slightly below the horizontal plane of movement of the bottoms of the wipers 62. The stem 76 intersects the mold bottom surface 78 inwardly of its periphery so that a flat horizontal border is provided on the rear and sides of the mold bottom surface 78 outwardly of the stem 76. The space beneath the downwardly facing surface 80 (hereafter referred to as the top surface) of the male mold 74 is free of any machine parts. That portion of the beam front portion 72 that is rearward of its front and is above the rearmost end 82 of the male mold 74 has a cavity 84 formed therein bounded by limbs 86 to thereby make the male mold end 82 visible from above.

Still referring to FIGS. 1 and 3-6, a pneumatic motor 88 is mounted to the back of the beam 70 and is confined within a cage 90 that is secured to the beam 70. A yoke 92 is secured to the front of the forwardly extending piston rod 94 of the motor 88. A pair of legs 96 of the yoke 92 bear against the sides of the beam 70 so that the operation of the motor 88 causes forward-rearward movement of the yoke 92 along the beam 70. The horizontal bars 12 are rotatably mounted in the legs 96 and extend forwardly thereof and outwardly of the sides of the beam front portion 72 and above and forwardly of the bottom 78 of the male mold 78. The fronts of the bars 12 are rotatably mounted in the ends of a spacer bar 98. A stud 100, secured to and extending rearwardly of the yoke 92, extends through the top of the cage 90. A knob 102 is mounted to the stud 100 forwardly of the cage 90 and a knob 104 is mounted to the stud 100 rearwardly of the cage 90. A bracket 105 is mounted to the top of the yoke 92 and a pneumatic motor 106 is pivoted to each side of the bracket 105. The downwardly directed piston rod 108 of each motor 106 is pivoted to an arm 110 that extends radially from the back of each bar 12 rearwardly of its associated leg 96. A movable pincers jaw 112, forming a part of one of the pincers 10, is mounted to the front of each bar 12 at the spacer bar 98. Each pincers jaw 112 in unison with its associated bar 12 is movable toward and away from a fixed pincers jaw 114 that is secured to the spacer bar 98.

The male mold 74 is connected by conduits 116 and 118 (FIGS. 1, 3, 5 and 6) to a source of refrigerant material that cools the male mold below ambient temperatures.

In the idle condition of the machine: the piston rod 18 is retracted into the motor 16 so that the bracket 22 is in a rearward position, the block 28 is yieldably urged forwardly of the bracket 22 by the springs 30 into a position wherein the block 28 engages the collars 31, the female mold bight 38 is spaced rearwardly of the rearmost end 82 of the male mold 74, and the female mold legs 40 are spaced outwardly of the sides of the male mold 74; the piston rod 56 is retracted into the motor 54 so that the wipers 62 are in rearward positions with respect to the female mold 36 and the plates 50, the slots 68 being so constructed that at this time the wipers 62 are swung outwardly about their vertex 64; the piston rod 94 is retracted into the motor 88 with the knob 102 bearing against the front of the cage 90 to thereby locate the pincers 10 in rearward positions that are forward of the front of the male mold 74; and the piston rods 108 are retracted into the motors 106 to thereby maintain the pincers 10 open with the pincers jaws 112 spaced outwardly of the pincers jaws 114.

Figure 9:
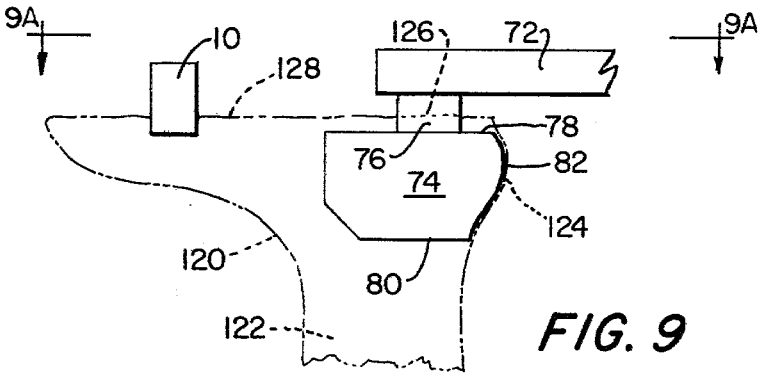
FIG. 9 is a schematic representation of a boot upper mounted in the machine at the beginning of the machine cycle.
Figure 9A:
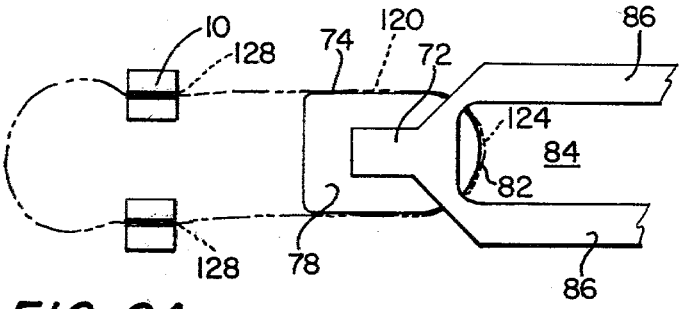
FIG. 9A is a view taken along the line 9A—9A of FIG. 9.

FIGS. 9 and 9A show in phantom an upper 120 of a boot that has a relatively long shaft 122 that, when being worn, extends well above the ankle of the wearer. Prior to presentation to the machine, the quarter of the upper and a thermoplastic counter located in a counter pocket within the quarter of the upper have been heated in any desired manner as, for example, by a mechanism such as that shown in U.S. Pat. No. 4,150,454 with the wipers 58 deleted or by a mechanism such as that shown in U.S. Pat. No. 3,977,033. This heating renders the quarter soft and pliant and renders the counter soft and adherent so that it can adhere to the walls of the counter pocket.

The heated upper 120 is mounted bottom-up on the male mold 74 with the quarter of the upper extending about the male mold 74, with the back line 124 of the upper located proximate to the rearmost end 82 of the male mold 74, with the margin 126 of the quarter of the upper 120 extending above the male mold bottom 78, and with the upper shaft 122 extending downwardly of the top surface 80 of the male mold 74. The fact that the space beneath the top surface 80 of the male mold is free of any machine parts, as described above, permits the upper shaft 122 to readily extend downwardly of the top surface 80 of the male mold 74. The side portions 128 of the upper margin are inserted between the open jaws 112,114 of the pincers 10. Because the bars 12 and the spacer bar 98 extend above the male mold 74, these members, which act to mount and close and open the pincers 10, do not interfere with the placement of the upper 120 on the male mold 74 and do not interfere with the upper shaft 122.

Now the motors 106 are actuated to project their piston rods 108 to thereby rotate the bars 12 in such directions as to force the pincers jaws 112 towards the pincers jaws 114 and thus cause the pincers 10 to grip the upper margin side portions 128. This is followed by an actuation of the motor 88 to project its piston rod 94 forwardly to cause the pincers 10 to move forwardly and thus stretch the upper quarter about the male mold 74 under the resilient force of the pressurized air in the motor 88 until the yieldable stretching force applied by the motor 88 is equalized by the resistance to stretching of the upper quarter. The engagement of the knob 104 with the back of the cage 90 determines the maximum extent of forward movement of the pincers 10.

Because the boot upper 120 is presented bottom-up on the mold 74 having its bottom surface 78 facing upwardly and because there is no obstruction above the rearmost end 82 of the male mold 74 due to the cavity 84 being above the male mold rearmost end 82, the operator now is able to observe whether the upper back line 124 is bearing against the male mold rearmost end 82, as is desireable for the below described molding and flanging operation. If the quarter back line 124 and the male mold rearmost end 82 are not in alignment, the operator so actuates the motors 106 and 88 as to open the pincers 10 and return them to their idle positions after which he again inserts the upper margin side parts 128 in the pincers 10, causes the pincers to close, and causes the pincers to move forwardly.

When the operator is satisfied that the pincers 10 have satisfactorily stretched the upper quarter about the male mold 74 with the upper back line 124 and the male mold rearmost end 82 in alignment, he actuates the motor 16 to project its piston rod 18 forwardly to thereby move the bracket 22 and the shafts 24 forwardly. This forward movement enables the springs 30 to move the block 28 forwardly in unison with the bracket 22 until the female mold bight 38 engages the upper back line 124 and presses it against the male mold rearmost end 82 upon which the forward movement of the block 28 is arrested. Continued forward movement of the bracket 22 and the shafts 24 causes the springs 30 to be compressed and causes the links 46 to swing inwardly about the pivot pins 47 to thereby move the female mold legs 40 inwardly and press the sides of the upper quarter against the sides of the male mold 74. The resistance to further inward movement of the female mold legs 40 due to their pressing of the sides of the upper quarter against the sides of the male mold 74 causes the piston rod 18 to terminate its forward movement. Now the soft and pliant upper quarter is caused to be molded to the shape of the male mold 74 by the pressing action of the female mold 36.

The aforementioned forward movement of the block 28 caused concomitant forward movement of the wipers 62 to place the wipers 62 adjacent to the margin of the quarter margin 126 in readiness for the below described flanging operation. A valve 130 (FIG. 4) mounted to the bracket 22 is actuated by a valve actuator 132 mounted to the block 28 pursuant to the forward movement of the bracket 22 with respect to the stationary block 28. Actuation of the valve 130 causes actuation of the motor 54 to project its piston rod 56 forwardly to thereby move the wipers 62 forwardly and inwardly about the vertex 64, the inward movement of the wipers being determined by the movements of the slots 68 along the pins 66 during the forward movements of the wipers 62. These forward and inward movements of the wipers 62 causes the wipers to move inwardly of the female mold 36 to engage the upper quarter margin 126 and flange the upper quarter by wiping or folding the upper quarter margin 126 against the periphery of the male mold bottom surface 78, this being permitted by the aforementioned border on the surface 78 that is outward of the stem 76.

Figure 10:
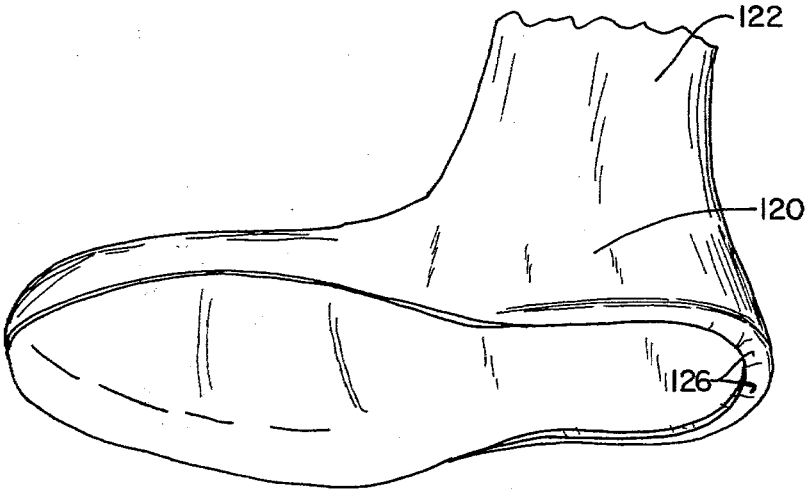
FIG. 10 is an isometric view of the boot upper after it has been removed from the machine.

The molded and flanged upper quarter is cooled sufficiently by the male mold 74 that is cooled as described above as to stiffen the upper quarter in its molded and flanged condition. The machine parts are now returned to their idle conditions and the upper 120 is removed from the machine. FIG. 10 illustrates the upper 120 having the flanged margin 126 at its quarter after the upper has been removed from the machine.

After removal from the machine of this invention, the upper 120 is mounted on a last having an insole secured to its bottom. The shoe assembly, formed of the last, the upper, and the insole, is then presented to a toe pulling over and lasting machine of the type shown in U.S. Pat. No. 3,902,211 for a pulling over and toe lasting operation. The flanged upper margin 126 at the quarter of the upper facilitates the proper placement of the upper on the last and minimizes the manual manipulation of the upper on the last by the operator during the operation of the pulling over and toe lasting machine.

There follows a recapitulation of those portions of the machine construction and its mode of operation that are particularly pertinent to this invention.

The machine has the function of molding the quarter of the upper 120 of a boot. The machine comprises the frame 14; the male mold 74; mounting means mounting the male mold 74 bottom-up; the female mold 36 so movably mounted to the frame 14 as to be movable between an idle position wherein the female mold 36 is spaced from the male mold 74 and a working position wherein the female mold 36 presses the quarter mounted on the male mold 74 against the rearmost end 82 and the sides of the male mold 74; means that include the motor 16 and a portion of its control (not shown) for initially maintaining the female mold 36 in its idle position; and actuable means that include the motor 16 and a portion of its control (not shown) for thereafter moving the female mold to its working position.

The machine described in the preceding paragraph is improved, in accordance with this invention, in that the mounting means comprises the stem 76 secured to and extending upwardly of the bottom surface 78 of the male mold 74 and connecting means so connecting the stem 76 to the frame 14 as to render the rearmost end 82 of the male mold 74 visible from above the male mold, the machine being so constructed and arranged that the space beneath the downwardly facing top surface 80 of the male mold 74 is free of any machine parts for a distance sufficient to accommodate the shaft 122 of the upper 120.

The connecting means referred to in the preceding paragraph comprises: the beam 70 mounted to the frame 14 and secured to the stem 76, the beam having the portion 72 overlying the rearmost end 82 of the male mold 74 with said portion 72 having a cavity 84 located directly above the rearmost end 82 of the male mold 74 to thereby effect said rendering of the rearmost end 82 of the male mold 74 visible.

The machine further comprises the pincers 10 located on each side of and forwardly of the male mold 74, each pincers having a pair of jaws 112,114 that are relatively movable between open and closed positions and each pincers being adapted when in its closed position to grip a side portion 128 of the upper margin. Jaw operating means are provided for moving each pair of jaws between open and closed positions. Pincers mounting means mount both pincers for forward-rearward movement. Pincers drive means effect forward-rearward movements of the pincers mounting means. Means, formed by a portion of the control (not shown) for the motors 106, initially cause the jaw operating means to retain both pairs of jaws 112,114 in their open positions. Means, formed by a portion of the control (not shown) for the motor 88, initially causes the pincers drive means to retain the pincers 10 in rearward positions. Means, formed by a portion of the machine control (not shown) for the motors 106, thereafter causes the jaw operating means to close both pairs of jaws 112,114. Means, formed by a portion of the machine control (not shown) for the motor 88, thereafter cause the pincers drive means to move the pincers 10 forwardly to thereby stretch the quarter about the male mold 74. Optionally operable means, formed by portions of the machine control (not shown) for the motors 88 and 106, thereafter cause the jaw operating means to return both pairs of jaws 112,114 to their open positions and cause the pincers drive means to return the pincers 10 to their rearward positions in the event that, pursuant to the stretching of the quarter about the male mold 74, the quarter back line 124 is not bearing against the male mold rearmost end 82. Means, formed by a portion of the machine control (not shown) for the motor 16, effective when the pincers 10 have been moved forwardly, effect said moving of the female mold 36 to its working position.

The mechanism set forth in the preceding paragraph has been improved, in accordance with this invention, as follows:

a. The pincers and the pincers mounting means comprise: the bar 12, extending alongside each side of the beam portion 72, each bar 12 being mounted for forward-rearward movement and each bar mounting a first pincers jaw 112, and the spacer bar 98, to which the second jaw 114 of each pincers is affixed, rotatably mounting the fronts of the bars 12;
b. The jaw operating means comprises a jaw operating motor 106 connected to each bar for effecting its rotation; and
c. The pincers drive means comprises the pincers drive motor 88 connected to the bars 12 for effecting their forward-rearward movements.

The quarter is so located on the male mold 74 that the margin 126 of the quarter extends upwardly of the bottom surface 78 of the male mold 74. The wipers 62 form wiping means located above the female mold 36 that are mounted to the frame 14 for movement in a wiping stroke from an idle position wherein the wiping means 62 is disengaged from the quarter margin 126 to a working position wherein the wiping means 62 has wiped the quarter margin 126 against the bottom surface 78 of the male mold 74 to thereby form a flange on the quarter. The motor 54 and a portion of the machine control (not shown) act as means for imparting the wiping stroke to the wiping means 62 after the actuation of the means for moving the female mold to its working position.

The machine as described in the preceding paragraph is improved, in accordance with this invention, in that the stem 76 so intersects the bottom surface 78 of the male mold 74 inwardly of the periphery of said bottom surface 78 as to provide a border on said bottom surface 78 between the stem 76 and said periphery of sufficient size as to accommodate the wiping means 62 in its working position.

I claim:

1. A boot upper quarter molding machine comprising: a frame; a male mold; mounting means mounting the male mold bottom-up; a female mold so mounted to the frame as to be movable between an idle position wherein the female mold is spaced from the male mold and a working position wherein the female mold presses a quarter mounted on the male mold against the rearmost end and the sides of the male mold; means for initially maintaining the female mold in its idle position; and actuable means for thereafter moving the female mold to its working position; characterized in that said mounting means comprises: a stem secured to and extending upwardly of the bottom surface of the male mold; and connecting means so connecting the stem to the frame as to render the rearmost end of the male mold visible from above the connecting means; the machine being so constructed and arranged that the space beneath the downwardly facing top surface of the male mold is free of any machine parts for a distance sufficient to accommodate the shaft of the boot upper.

2. The machine of claim 1 wherein said connecting means comprises: a beam mounted to the frame and secured to the stem, said beam having a portion overlying the rearmost end of the male mold with said portion having a cavity located directly above the rearmost end of the male mold to thereby effect said rendering of the rearmost end of the male mold visible.

3. The machine of claim 2 further comprising: a pincers located on each side of and forwardly of the male mold, each pincers having a pair of jaws that are relatively movable between open and closed position, each pincers being adapted when in its closed position to grip a side portion of the upper margin; jaw operating means for relatively moving each pair of jaws between open and closed positions; pincers mounting means mounting both pincers for forward-rearward movement; pincers drive means for effecting forward-rearward movements of the pincers mounting means; means for initially causing the jaw operating means to retain both pairs of jaws in their open positions; means for initially causing the pincers drive means to retain the pincers in rearward positions; means for thereafter causing the jaw operating means to close both pairs of jaws; means for thereafter causing the pincers drive means to move the pincers forwardly to thereby stretch the quarter about the male mold; optionally operable means for thereafter causing the jaw operating means to return both pairs of jaws to their open positions and for causing the pincers drive means to return the pincers to said rearward positions in the event that, pursuant to the stretching of the quarter about the male mold, the quarter back line is not bearing against the male mold rearmost end; and means, effective when the pincers have been moved forwardly, for effecting said moving of the female mold to its working position; characterized in that said pincers and said pincers mounting means comprise: a bar extending alongside each side of said beam portion, each bar being mounted for forward-rearward movement and each bar mounting a front pincers jaw; and a spacer bar, to which the second jaw of each pincers is affixed, rotatably mounting the fronts of the bars; characterized in that said jaw operating means comprises: a jaw operating motor connected to each bar for effecting its rotation; and characterized in that said pincers drive means comprises: a pincers drive motor connected to the bars for effecting their forward-rearward movements.

4. The machine of claim 1, claim 2 or claim 3 wherein the quarter is so located on the male mold that the margin of the quarter extends upwardly of the bottom surface of the male mold, the machine further comprising: wiping means located above the female mold and mounted to the frame for movement in a wiping stroke from an idle position wherein the wiping means is disengaged from the quarter margin to a working position wherein the wiping means has wiped the quarter margin against the bottom surface of the male mold to thereby form a flange on the quarter; and means for imparting the wiping stroke to the wiping means after the actuation of the means for moving the female mold to its working position; characterized in that the stem so intersects the bottom surface of the male mold inwardly of the periphery of said bottom surface as to provide a border on said bottom surface between the stem and said periphery of sufficient size to accommodate the wiping means in its working position.

* * * * *

UNITED STATES PATENT AND TRADEMARK OFFICE

CERTIFICATE OF CORRECTION

PATENT NO. : 4266313

DATED : May 12, 1981

INVENTOR(S) : Walter Vornberger

It is certified that error appears in the above-identified patent and that said Letters Patent are hereby corrected as shown below:

Column 3, line 49, change the second occurrence of "78" to --74--.

Column 8, line 50, change "front" to --first--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*